US006208222B1

(12) United States Patent
Sinsky

(10) Patent No.: US 6,208,222 B1
(45) Date of Patent: Mar. 27, 2001

(54) ELECTROMECHANICAL PHASE SHIFTER FOR A MICROSTRIP MICROWAVE TRANSMISSION LINE

(75) Inventor: Jeffrey H. Sinsky, Marlboro, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/311,493

(22) Filed: May 13, 1999

(51) Int. Cl.[7] ..... H01P 9/00
(52) U.S. Cl. ..... 333/161; 333/156
(58) Field of Search ..... 333/161, 159, 333/156, 139

(56) References Cited

U.S. PATENT DOCUMENTS 5,473,294 * 12/1995 Mizzoni et al. ..... 333/137 X

FOREIGN PATENT DOCUMENTS

46606 * 3/1985 (JP) ..... 333/139
242001 * 10/1988 (JP) ..... 333/139

* cited by examiner

*Primary Examiner*—Benny Lee
(74) *Attorney, Agent, or Firm*—David L. Davis

(57) ABSTRACT

An electromechanical phase shifter for a microstrip microwave transmission line includes a conductive base plate and a pair of microstrip transmission line segments supported parallel to each other and parallel to and spaced from the base plate. A movable microstrip transmission line bridges the pair of transmission line segments and is movable therealong to provide a short circuit therebetween. A movable ground element is coupled to the bridging transmission line for movement therewith and is in contact with the pair of transmission line segments and the base plate. The spacing between the movable bridging transmission line and the ground element is maintained at one quarter wavelength of the center frequency of the signal frequency band.

5 Claims, 2 Drawing Sheets

ELECTROMECHANICAL PHASE SHIFTER FOR A MICROSTRIP MICROWAVE TRANSMISSION LINE

BACKGROUND OF THE INVENTION

This invention relates to microstrip microwave transmission lines and, more particularly, to a transmission line phase shifter which is effective, inexpensive and easy to fabricate.

There are numerous applications where a microstrip microwave transmission line is required to have a phase shifter inserted therein. For example, phase shifters are commonly used in phased array antenna systems. At the present time, electromechanical phase shifters exist which require a quadrature hybrid circuit so that a signal passes through the quadrature hybrid circuit and bounces off a variable length delay line. The bounced signal then returns through the isolated port of the quadrature hybrid circuit. Such a device operates in a reflective mode, which limits the operating bandwidth and adds complexity and cost to the design. Line stretchers are also known to exist which allow for a continuously variable phase shift using transmission, rather than reflection. However, line stretchers require more expensive hardware since they are typically telescoping coaxial structures. Accordingly, a need exists for a less expensive phase shifter.

SUMMARY OF THE INVENTION

The inventive phase shifter is designed for use over a frequency band having a center frequency and includes a conductive base plate and a pair of microstrip transmission line segments supported parallel to each other and parallel to and spaced from the base plate. A movable microstrip transmission line bridges the pair of transmission line segments and is movable therealong to provide a short circuit therebetween. A movable ground element is coupled to the movable transmission line for movement therewith and is in contact with the pair of transmission line segments and the base plate. The spacing between the movable transmission line and the ground element is maintained at one quarter wavelength at the center frequency.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION OF THE INVENTION

Figure 1:
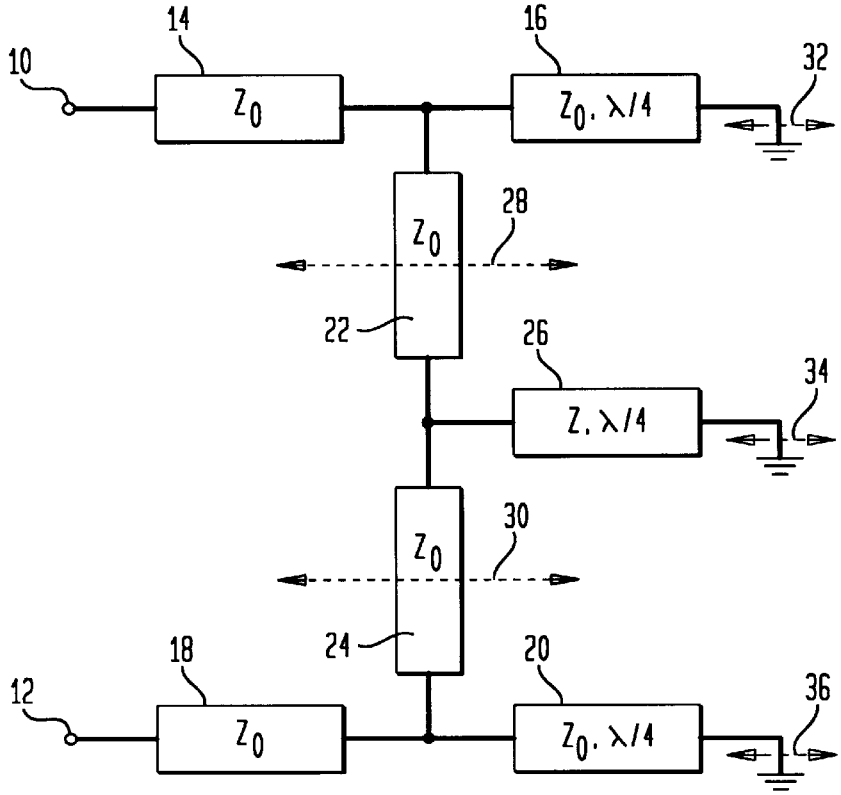
FIG. 1 is a schematic circuit diagram of a phase shifter according to the present invention.

Referring to the drawings, in the schematic circuit diagram of FIG. 1, the terminals 10, 12 are the input and output terminals, respectively, for the inventive phase shifter which is adapted to be installed in series with a microstrip microwave transmission line of characteristic impedance $Z_0$ operating over a frequency band having a center frequency. The input terminal 10 is connected to a transmission line segment comprised of two parts. The first part 14 of that transmission line segment has a characteristic impedance $Z_0$ and is of variable length and the second part 16 of the transmission line segment has a characteristic impedance $Z_0$ and is of a fixed length equal to one quarter wavelength ($\lambda/4$) at the center frequency. Similarly, the terminal 12 is connected to a transmission line segment having a first part 18 of characteristic impedance $Z_0$ and of variable length and a second part 20 of characteristic impedance $Z_0$ and of a fixed length equal to one quarter wavelength at the center frequency. The transmission line segments connected to the terminals 10, 12 are bridged by a movable transmission line also of characteristic impedance $Z_0$. The movable transmission line can be considered to have two parts 22, 24 which are connected to a connecting transmission line part 26 of impedance Z and; of a length equal to one quarter wavelength ($\lambda/4$)at the center frequency. As shown, the distal ends of the transmission line segment parts 16, 20, 26 are connected to ground. The movable transmission line can be moved back and forth, as indicated by the arrows 28, 30 and the ground connections are coupled to move therewith, as indicated by the arrows 32, 34, 36. Thus, the phase shift of a signal between the terminals 10 and 12 is determined by the length of transmission line including the parts 14, 22, 24, and 18. By having the transmission line segment parts 16, 26, 20 terminated to ground and being of length equal to one quarter wavelength at the center frequency, these transmission line parts provide a high impedance and appear to be an open circuit so as to be virtually invisible to the transmission path including the transmission line parts 14, 22, 24, 18.

Figure 2:
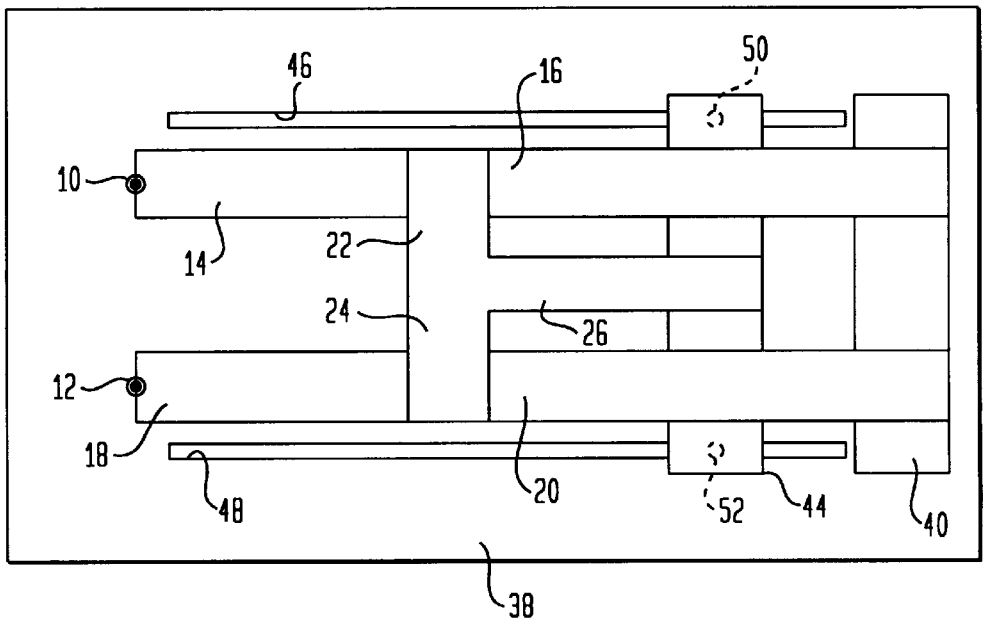
FIG. 2 is a top plan view schematically showing the mechanical layout of an embodiment of the present invention.
Figure 3:
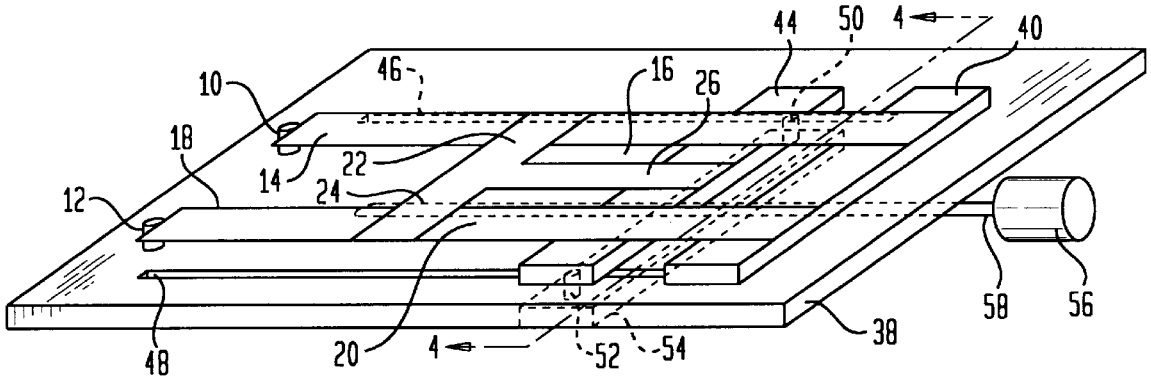
FIG. 3 is a perspective schematic view of the embodiment of the present invention shown in FIG. 2.
Figure 4:
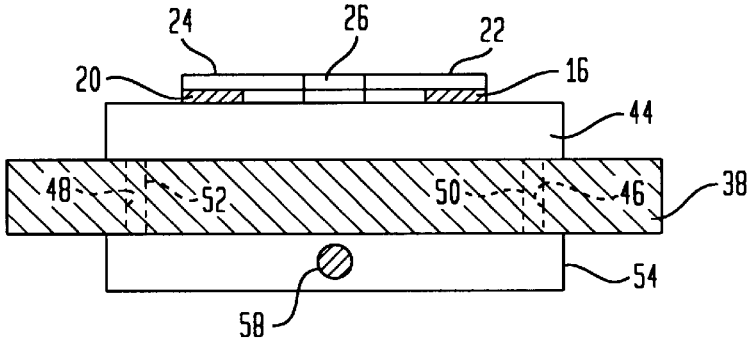
FIG. 4 is a cross sectional schematic view taken along the line 4—4 in FIG. 3.
Figure 5:
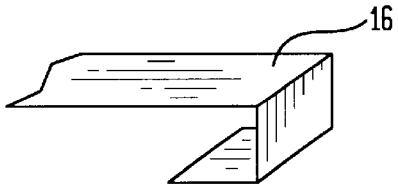
FIGS. 5 and 6 show alternative illustrative embodiments for spacing the transmission lines from the base plate.
Figure 6:
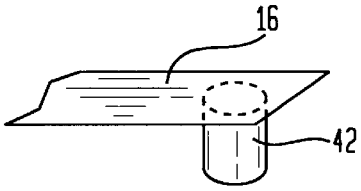

FIGS. 2–4 illustrate an implementation for the circuitry shown in FIG. 1. Thus, a conductive base plate 38 is provided which is connected to system ground. Extending through the base plate 38 are the terminals 10, 12 (see FIGS. 2 and 3), which illustratively consist of SMA type coaxial connectors. As seen in FIGS. 2 and 3, the transmission line parts 14, 16 and 18, 20 are preferably formed as thin strips of copper sheet. As is known, the height of a microstrip transmission line above the ground plane is a function of the width of the transmission line to achieve a desired characteristic impedance. Accordingly, the height of the terminals 10, 12 above the upper surface of the base plate 38 is selected to achieve the desired characteristic impedance. The transmission lines are supported at their other ends by a fixed support 40, which may be either a conductor or an insulator. FIG. 5 illustrates an alternate support for the far end of the microstrip transmission line part 16, which is provided by bending the strip. FIG. 6 shows a further alternate support for the microstrip transmission line part 16, which is a single block 42 for each strip. The thickness of the fixed support 40 (FIGS. 2, 3, 4), the height of the bend of the transmission line part 16 (FIG. 5) and the height of the block 42 (FIG. 6) are all equal to the height of the terminals 10, 12 over the base plate 38.

The bridging transmission line parts 22, 24 and the connecting part 26 are preferably formed unitarily as a T-shaped piece of copper sheet. Grounding of the transmission lines is provided by a ground element 44, which illustratively is a copper bar of thickness equal to the height of the terminals 10, 12 over the base plate 38. The ground element 44 remains in contact with the base plate 48 and the transmission line parts 16, 20. The base of the T-shaped piece is secured to the ground element 44 so that the spacing between the center of the ground element 44 and the center of the cross bar of the T-shape is equal to one quarter wavelength at the center frequency of operation. Accordingly, by moving the ground element 44 back and forth in a direction parallel to the transmission line segments, the length of the transmission path between the terminals 10, 12 may be selectively varied to introduce a desired phase shift between the terminals 10, 12. Since the ground element 44, which is in contact with the transmission line segments and the base plate, is one quarter wavelength behind the bridging transmission line, the excess microstrip between the bridging transmission line and the sliding ground element 44 appears invisible to the transmission path, since the sliding ground element 44 always follows the bridging transmission line by a quarter wavelength.

It is proposed to use an electric motor, illustratively a stepper motor, to move the ground element 44 along the transmission line segments. Accordingly, the base plate 38 is formed with a pair of open slots 46, 48 outwardly of and parallel to the transmission line segments. The ground element 44 is a rigid member which extends outwardly past the transmission line segments. A pair of pins 50, 52 are secured to the ground element 44 and extend through the slots 46, 48, respectively. The pins 50, 52 are also secured to a bar 54 (see FIGS. 3, 4) beneath the base plate 38. A motor 56 (see FIG. 3), illustratively a stepper motor, has its output shaft 58 (see FIGS. 3, 4) coupled to the bar 54, as by threads on the shaft 58 engaging threads on the bar 54, for example. Thus, rotation of the output shaft 58 in a first direction causes the assembly of the bar 54, the ground element 44, and the bridging transmission line 22, 24, 26 to be moved to shorten the transmission path between the terminals 10, 12, and rotation of the output shaft 58 in the opposite direction has the opposite effect.

Accordingly, there has been disclosed an electromechanical phase shifter for a microstrip microwave transmission line which is effective, inexpensive and easy to fabricate. While illustrative embodiments of the present invention have been disclosed herein, it will be appreciated that various adaptations and modifications to the disclosed embodiments are possible and it is intended that this invention be limited only by the scope of the appended claims.

What is claimed is:

1. A phase shifter for a microstrip microwave transmission line operating in a frequency band having a center frequency, comprising:

a conductive base plate;

a first fixed microstrip transmission line supported parallel to and spaced from the base plate so as to have a predetermined characteristic impedance;

a second fixed microstrip transmission line supported parallel to and spaced from the first transmission line, and parallel to and spaced from the base plate so as to have said predetermined characteristic impedance;

a first connector secured to a first end of said first transmission line;

a second connector secured to a first end of said second transmission line;

a movable microstrip transmission line in physical and electrical contact with and movable along both said first and second transmission lines toward and away from said first ends, said movable transmission line having said predetermined characteristic impedance; and a movable conductive ground element coupled to said movable transmission line for movement therewith, said ground element being in physical and electrical contact with said first and second transmission lines and said base plate on the other side of said movable transmission line from said first ends;

wherein there is a spacing between the point of contact of said movable transmission line with each of said first and second transmission lines and the point of contact of said ground element with each of said first and second transmission lines, respectively, said spacing is equal to one quarter wavelength at said center frequency.

2. The phase shifter according to claim 1 further comprising:

a connecting microstrip transmission line connected at a first end to said movable transmission line and at a second end to said ground element, said connecting microstrip transmission line being situated between and parallel to said first and second transmission lines and having a length between the first and second ends thereof equal to one quarter wavelength at said center frequency.

3. The phase shifter according to claim 1 further comprising:

an electric motor coupled to move said movable transmission line and said ground element along said first and second transmission lines.

4. The phase shifter according to claim 3 wherein:

said ground element consists of a rigid element extending transverse to said first and second transmission lines and outwardly beyond said first and second transmission lines;

said base plate includes a pair of open slots extending parallel to said first and second transmission lines outwardly thereof;

a pair of pins extend through respective ones of said slots and are secured at first ends thereof to said ground element;

a bar is secured to the second ends of said pair of pins on the side of said base plate opposite said ground element; and said motor has an output shaft coupled to selectively move said bar back and forth in a direction parallel to said slots.

5. The phase shifter according to claim 3 wherein said electric motor is a stepper motor.

* * * * *